US005891165A

United States Patent [19]

Buckner

[11] Patent Number: 5,891,165

[45] Date of Patent: Apr. 6, 1999

[54] PACIFIER USEABLE WITH A LIQUID DISPENSING SYRINGE

[76] Inventor: Mark B. Buckner, 60 Sand Creek Cir., Sherman, Tex. 75092

[21] Appl. No.: 70,423

[22] Filed: Apr. 30, 1998

[51] Int. Cl.[6] ..... A61J 17/00

[52] U.S. Cl. ..... 606/234; 606/235; 606/236; 604/76; 604/77; 604/79; 604/90; D24/194

[58] Field of Search ..... 606/234, 235, 606/236; 604/77, 76, 79, 90, 91, 93; D24/194

[56] References Cited

U.S. PATENT DOCUMENTS

| | | | |
|---|---|---|---|
| D. 391,642 | 3/1998 | Fountain | D24/194 |
| 5,078,734 | 1/1992 | Noble | 606/236 |
| 5,176,705 | 1/1993 | Noble | 606/236 |
| 5,244,122 | 9/1993 | Botts | 222/133 |
| 5,383,906 | 1/1995 | Burchett et al. | 606/236 |
| 5,431,680 | 7/1995 | Jones | 606/236 |
| 5,512,047 | 4/1996 | Dvorak | 604/77 |
| 5,700,279 | 12/1997 | Blando . | |

*Primary Examiner*—Michael Buiz
*Assistant Examiner*—Uen Ngo
*Attorney, Agent, or Firm*—Konneker & Smith, P.C.

[57] ABSTRACT

A liquid dispensing infant pacifier has a mouth guard with a hollow tubular connector portion on its rear side over an opening extending through the mouth guard from its rear side to its front side. The connector has a configuration similar to that of a catheter hub and is selectively and removably connectable to either the interiorly threaded discharge end of a conventional liquid dispensing syringe or a closure cap portion of the pacifier which serves to block fluid flow through the connector portion. Projecting outwardly from the front side of the mouth guard, over the opening therein, is a specially designed double-walled tubular nipple which is formed from a partially everted pliable material tube and has a large interior flow space extending outwardly through the open front end of the nipple body. Due to the nipple construction, when the syringe is attached to the mouth guard, liquid discharged from the syringe easily flows through the nipple into an infant's mouth without any sucking force being exerted on the nipple by the infant. When the syringe is replaced with the closure cap the mouth guard connector is blocked to preclude undesirable inward air flow through the mouth guard connector as an infant sucks on the nipple.

18 Claims, 2 Drawing Sheets

PACIFIER USEABLE WITH A LIQUID DISPENSING SYRINGE

BACKGROUND OF THE INVENTION

The present invention generally relates to infant pacifiers and, in a preferred embodiment thereof, more particularly relates to a pacifier adapted to deliver a liquid into an infant's mouth using a conventional syringe removably connected to the pacifier in place of a closure cap portion thereof.

An infant pacifier is a relatively simple device used to appease crying children or to discourage thumb-sucking or other idiosyncrasies, and is typically provided with a generally nipple-shaped projection which is placed in the infant's mouth. Various attempts have previously been made to incorporate a liquid delivery structure into a pacifier so that, for example, medicinal or nutritional liquids can be administered to the infant while he or she sucks on the pacifier.

One common approach, representatively illustrated in U.S. Pat. No. 5,078,734 to Noble, U.S. Pat. No. 5,176,705 to Noble, U.S. Pat. 5,512,047 to Dvorak, and U.S. Design Pat. No. D391,642 to Fountain, has been to fill the flexible nipple portion of the pacifier, through an open back end portion thereof, with the selected liquid to be administered, then close off the back end of the nipple with a replaceable cap, place the nipple in the infant's mouth, and then let the infant suck the liquid out of the nipple through a small orifice in its front end. A drawback to this previously proposed approach to administering liquid to an infant through a pacifier device is that the liquid is delivered to the infant only if the infant is actually sucking on the pacifier. If the infant will not suck on the pacifier, the liquid remains in the pacifier and does not benefit the infant.

Another previously proposed approach to this liquid delivery problem is illustrated and described in U.S. Pat. No. 5,431,680 to Jones in which a device for orally administering liquid to infants includes an elongated liquid container having a generally pacifier-shaped front end portion and an open back end. After the desired type and quantity of liquid is placed in the container, a plunger device is sealingly inserted into the open back end of the container. The pacifier-shaped front end of the container is then placed in the infant's mouth, and the plunger is depressed to force the liquid out of the container into the infant's mouth via a small diameter orifice in the front end of the container. While this approach permits the liquid to be administered to the infant without any sucking force being applied to the device, the device is too long and unwieldy to be suitable in a pure pacifier function-i.e., left for periods of time in the infant's mouth without adult or other external support of the back end of the device.

As can be readily be seen from the foregoing, a need exists for a pacifier device which can function satisfactorily as a pacifier as well as a liquid delivery device which is operable in the absence of an infant sucking force exerted thereon. It is to this need that the present invention is directed.

SUMMARY OF THE INVENTION

In carrying out principles of the present invention, in accordance with a preferred embodiment thereof, a liquid dispensing pacifier is provided which includes a body member, representatively in the form of a mouth guard, a nipple, and a closure cap. The mouth guard has front and rear sides between which an opening extends, and a hollow connector member projecting outwardly from its rear side and having an internal flow passage communicated with the mouth guard opening. Illustratively, the mouth guard is of a molded plastic material, and the connector member is molded integrally with the balance of the mouth guard. The nipple is connected to and projects outwardly from the front mouth guard side and has an interior flow passage communicating with the mouth guard opening.

According to one aspect of the invention, the mouth guard connector is configured to be threadingly and removably connected to either the discharge end of a conventional liquid dispensing syringe, or to the removable closure cap. Preferably, the connector has a configuration similar to that of a catheter hub shaped to thread into the internally threaded attachment collar of the syringe, with the closure cap having an internally threaded portion similar to that of the syringe.

With the discharge end of the syringe coupled to the mouth guard connector, and the nipple in an infant's mouth, a selected liquid within the syringe body may be orally administered by simply depressing the syringe plunger to force the liquid into the nipple to permit the liquid to flow therethrough into the infant's mouth. After the liquid is administered, the syringe may be quickly removed from the mouth guard connector and replaced with the closure cap which serves to block fluid flow through the connector to prevent undesirable inflow of air into the connector as the infant sucks on the nipple.

According to another aspect of the invention, the nipple which projects outwardly from the front side of the mouth guard has a unique double-walled tubular configuration and is formed from a pliable material tube having a first outer end secured to the front side of the mouth guard over the opening therein, and a longitudinally intermediate portion spaced forwardly apart from the front side of the mouth guard. The tube additionally has a second outer end, and a second end portion extending from the longitudinally intermediate portion to the second outer end of the tube. The second end portion of the tube is everted and coaxially extends rearwardly and outwardly along the first end portion of the tube, with the second outer end of the tube being secured to the front side of the mouth guard.

Preferably, the second end portion of the tube is radially larger than its first end portion in a manner such that an annular air space is formed between the coaxially telescoped first and second end portions of the tube. Due to the unrestricted, relatively large diameter flow passage within the tubular nipple, oral delivery of a liquid to an infant using a conventional syringe coupled to the mouth guard is not dependent on any sucking force exerted on the nipple by he infant. The liquid discharged from the syringe may simply be flowed by gravity into the infant's mouth if he or she will not suck on the nipple. The use of this double-walled tubular nipple construction also gives added structural strength to the nipple while at the same time automatically forming a smooth, edge-free annular outer discharge end portion of the nipple. The annular air space between the two nipple side layers also gives the nipple a desirable lateral softness.

DETAILED DESCRIPTION

Figures 1, 1A, 1B, 2, 3:
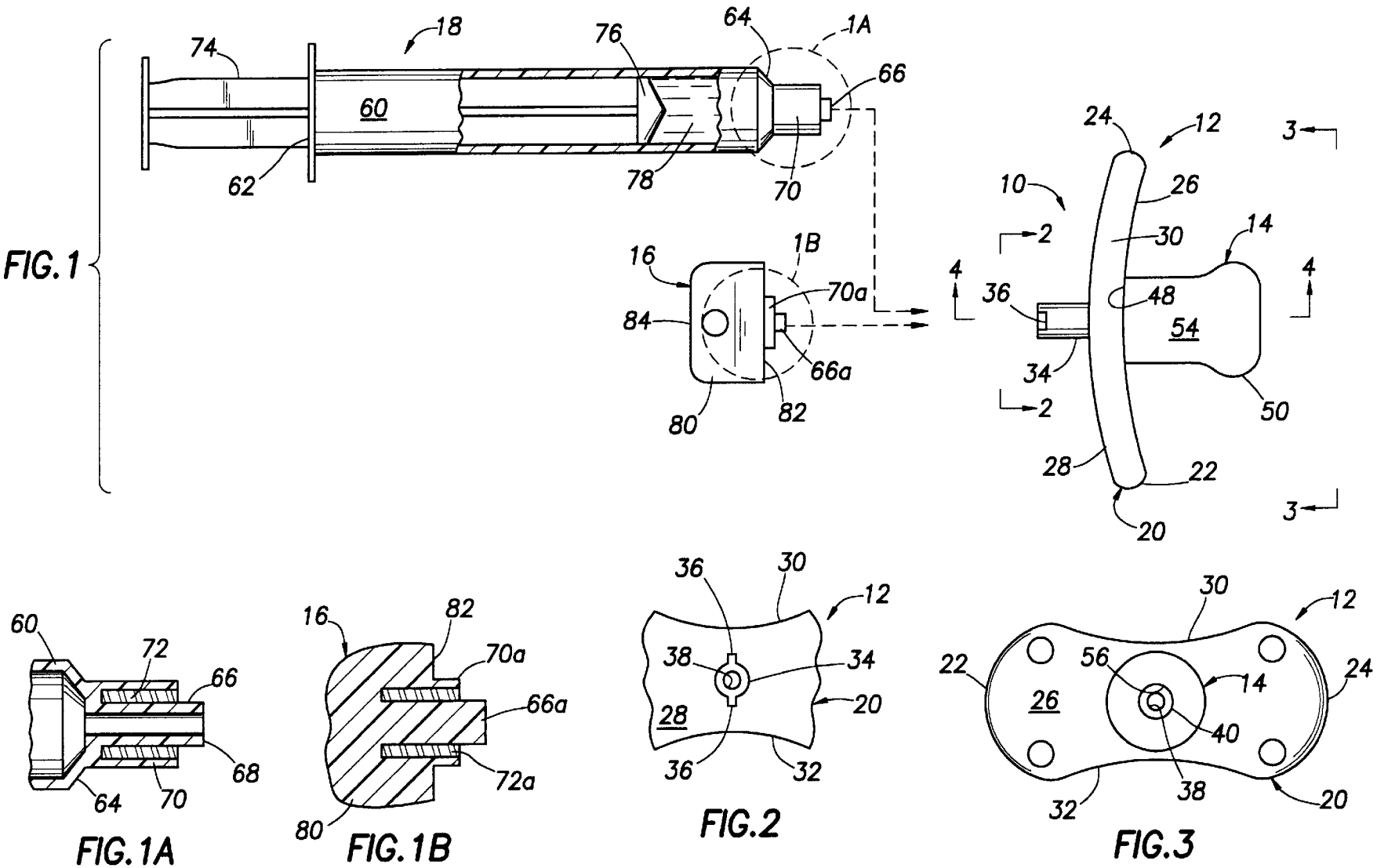
FIG. 1 is a partially exploded top plan view of a liquid dispensing pacifier embodying principles of the present invention and additionally illustrates a conventional syringe that may be removably connected to the pacifier in place of the illustrated removable cap portion thereof.
FIG. 1A is an enlarged scale cross-sectional detail view of the dashed circle area "1A" of the syringe shown in FIG. 1.
FIG. 1B is an enlarged scale cross-sectional detail view of the dashed circle area "1B" of the removable cap portion shown in FIG. 1.
FIG. 2 is a partial rear side elevational view of the pacifier, with its cap portion removed, taken generally along line 2—2 of FIG. 1.
FIG. 3 is a front side elevational view of the pacifier taken along line 3—3 of FIG. 1.

The present invention provides a specially designed liquid dispensing infant pacifier 10 which is shown in partially exploded form in FIG. 1 and includes a body 12, a nipple 14 placeable in an infant's mouth, and a closure cap 16 removably securable to the body 12. As will be later described herein, a conventional syringe 18 may be removably secured to the body 12, in place of the closure cap 16, and used to inject a liquid, such as a medicinal liquid or a nutritional liquid, through the body 12 and the nipple 14 into an infant's mouth.

Body 12 is representatively of a molded plastic, one-piece construction and, as shown in FIGS. 1–3, includes a curved, horizontally elongated, plate-shaped mouth guard portion 20 having left and right ends 22 and 24, a concave front side 26, a convex rear side 28, and concave upper and lower side edges 30 and 32. Projecting outwardly from a central portion of the rear side 28 of the mouth guard 20 is a hollow tubular syringe/cap connector portion 34 which has a diametrically opposite pair of tabs 36 projecting radially outwardly from its outer or rear end. Connector portion 34 is shaped similarly to a catheter hub configured to be threadingly connected to the discharge end of the syringe 18 and has a circularly cross-sectioned flow passage 38 extending axially therethrough. As later described herein, with the syringe 18 removed therefrom the connector portion 34 is also threadingly connectable to the closure cap 16.

Figure 4A:
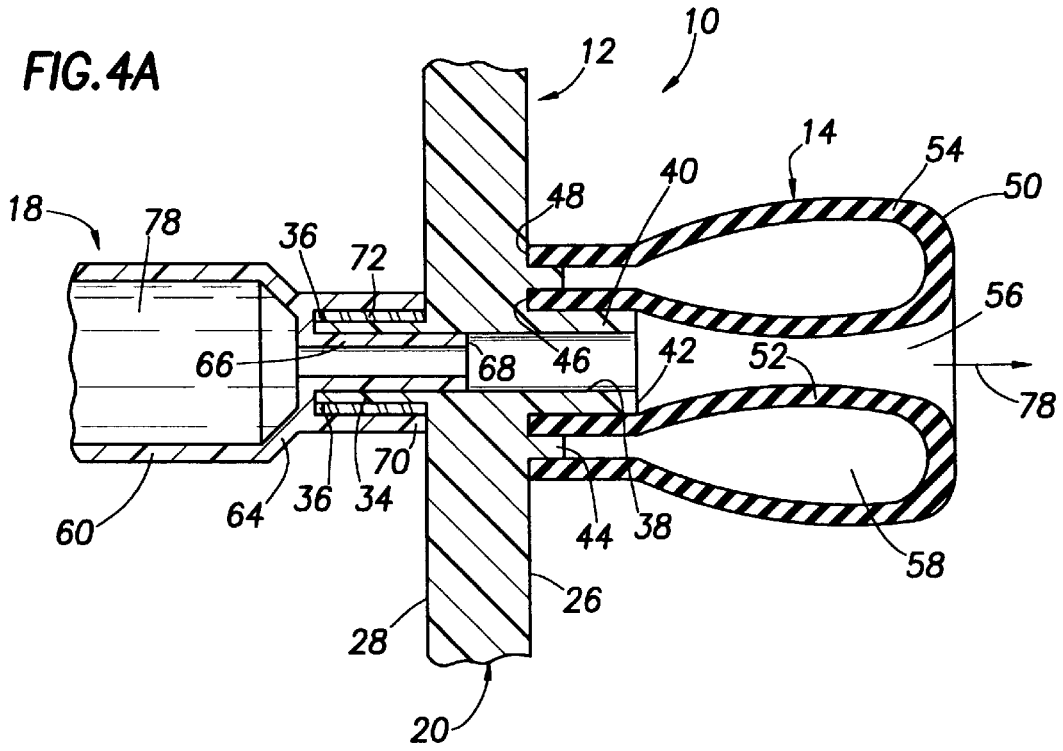
FIG. 4A is an enlarged scale partial cross-sectional view through the pacifier, with the syringe operatively installed thereon, taken along line 4—4 of FIG. 1.

The axial passage 38 within the interior of the connector portion 34 extends forwardly through the mouth guard 20, as cross-sectionally illustrated in FIG. 4A, and then through the interior of a hollow tubular nipple connector projection 40 formed on the front side 26 of the mouth guard 20 and having an open front end 42. This tubular projection 40 is outwardly circumscribed by a somewhat shorter annular projection 44 also molded on the front side 26 of the mouth guard 20.

Like the pacifier body portion 12 just described, the nipple 14 is of a unique configuration that facilitates the oral delivery of a liquid to an infant. With reference now to FIG. 4A, the nipple 14 is defined by an elongated, generally tubular member formed from a pliable material such as, by way of example, a suitable vinyl, latex, rubber or rubberized plastic material. The tubular member has first and second opposite ends 46 and 48, a thickened longitudinally intermediate portion 50, a first end portion 52 extending between the end 46 and the longitudinally intermediate portion 50, and a second end portion 54 extending between the end 48 and the longitudinally intermediate portion 50. The outer diameter of the second end portion 54 is somewhat greater than the outer diameter of the first end portion 52, with the longitudinally intermediate portion 50 defining an appropriately shaped sloped transition between these different diameter longitudinal portions of the unitary nipple tube.

Nipple 14 is secured to the front side 26 of the mouth guard 20 by forcing an outer end portion of the tube section 52 coaxially over the nipple connector projection 40, radially inwardly of the annular projection 44 (see FIG. 4A) and suitably anchoring this tube end portion in place, for example by using a suitable nontoxic adhesive material. The larger diameter tube section 54 is everted (i.e., turned inside out) and longitudinally folded rearwardly and outwardly over the tube section 52, with the tube end 48 being forced outwardly over and anchored to the annular projection 44 using, for example, a suitable nontoxic adhesive material.

As can be seen in FIG. 4A, along its length the in-place nipple 14 has a sizable circularly cross-sectioned interior flow passage 56 that communicates with and defines a forward extension of the flow passage 38 within the nipple connector projection 40, the flow passage 56 opening outwardly through the front end of the nipple 14. As can also be seen in FIG. 4A, an annular air space 58 is defined between the telescoped longitudinal sections 52,54 of the unitary nipple tube.

Referring now to FIGS. 1 and 1A, the syringe 18, as previously mentioned, is of a conventional construction and includes a hollow tubular body 60 having an open rear or left end 62 and a transverse wall 64 at its opposite front or right discharge end. Projecting forwardly from the end wall 64 is a reduced diameter hollow tubular fluid discharge portion 66 having an open front end 68, the interior passage within the discharge portion 66 extending rearwardly through the body end wall 64 and communicating with the interior of the body 60. An annular attachment collar 70 is formed on the discharge end of the body 60, outwardly circumscribes a rear section of the tubular fluid discharge portion 66, and is provided with interior connection threads 72.

An elongated plunger 74 is coaxially receivable in the body 60, through its open rear end 62, and is provided at its front end with an elastomeric seal structure 76 which slidingly and sealingly engages the inner side surface of the hollow body 60. In a conventional manner, a liquid 78 disposed within the body 60 forwardly of the plunger seal structure 76 may be selectively forced outwardly through the tubular fluid discharge portion 66 in response to a forcible forward movement of the plunger 74 forwardly or rightwardly through the interior of the body 60.

As will be recalled, the syringe/cap connector structure 34 projecting outwardly from the rear side 28 of the mouth guard 10 has a shape similar to that of a catheter hub configured to be threadingly connected to the discharge end of the syringe 18. Accordingly, with the closure cap 16 removed from the mouth guard 20, the syringe 18 may be quickly and easily connected to the mouth guard portion 20 of the pacifier body 12 by simply inserting the syringe/cap connector portion 34 coaxially into the discharge end or the syringe 18, between the tubular syringe discharge portion 66 and the annular collar 70, and then rotating the syringe body 60 about its longitudinal axis to lockingly engage the collar threads 72 and the connector tabs 36 as cross-sectionally illustrated in FIG. 4A.

Thus, to orally administer the liquid 78 to an infant in a convenient and reliable manner, the liquid is drawn into the interior of the syringe body 60, the syringe 18 is connected to the mouth guard 20 as just described, the specially designed nipple 14 is placed in the infant's mouth, and the plunger 74 is depressed to discharge the liquid 78 from the syringe 18 sequentially through its tubular discharge portion 66, the mouth guard and nipple flow passages 38 and 56, and into the infant's mouth as indicated by the arrow 78*a* in FIG. 4A.

Importantly, due to the relatively large diameter flow passage 56 within the specially designed nipple 14, oral delivery of the liquid 78 to the infant is not dependent on any sucking force exerted on the nipple 14 by the infant —the liquid 78 may simply be flowed by gravity into the infant's mouth if he or she will not suck on the nipple 14. The use of this unique double-walled nipple construction also gives added structural strength to the nipple while at the same time automatically forming a smooth, edge-free annular outer end portion of the nipple. The illustrated annular air space between the nipple layers also gives the nipple a desirable lateral softness.

Another advantage of the pacifier 10 of the present invention is that after it has been used as a device for orally administering a selected liquid to an infant it can be used purely as a pacifier simply by removing the syringe 18 from the mouth guard 20 and replacing the removed syringe 18 with the specially configured closure cap 16 which will now be described with reference to FIGS. 1, 1B and 4B.

Closure cap 16 has a generally disc-shaped body 80 with opposite front and rear sides 82 and 84. Coaxially projecting outwardly from the front side 82 are a solid cylindrical portion 66*a* and a somewhat shorter annular attachment collar 70*a* which outwardly circumscribes the cylindrical portion 66*a* and is provided with internal threads 72*a*. As can be seen by comparing FIGS. 1A and 1B, the front side elements 66*a*,70*a* and 72*a* on the closure cap 16 (see FIG. 1B) respectively have configurations identical to the front end elements 66,70 and 72 on the syringe 18 (see FIG. 1A), with the exception that the cylindrical portion 66*a* of the cap 16 is solid instead of being hollow like the syringe element 66.

Figure 4B:
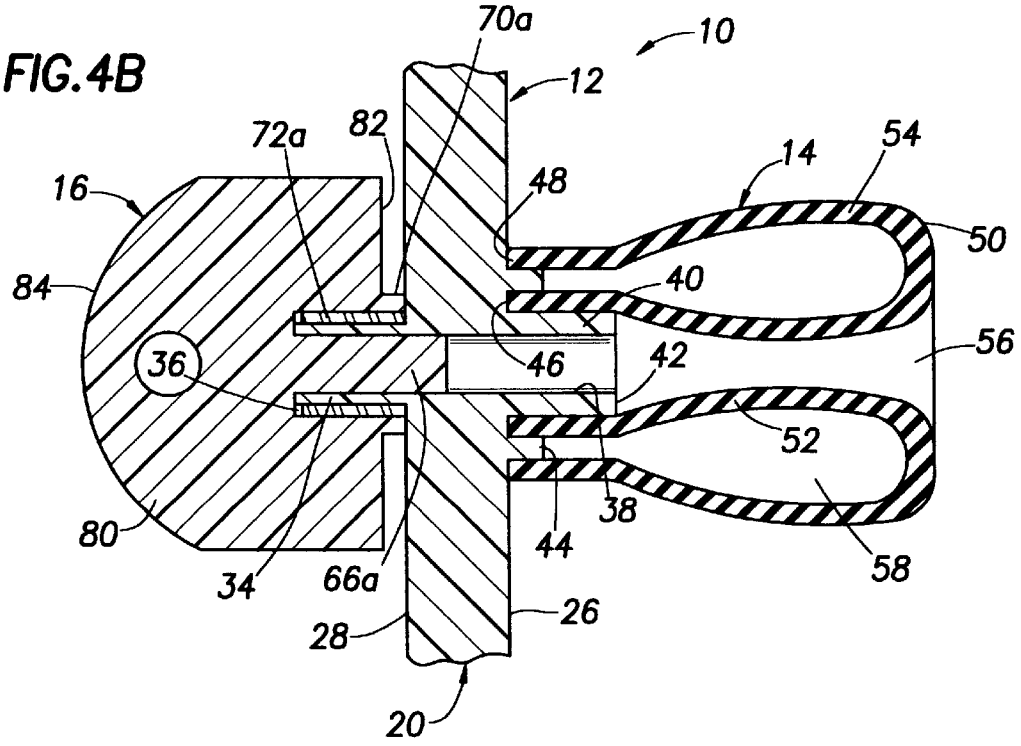
FIG. 4B is an enlarged scale partial cross-sectional view through the pacifier, with its cap portion installed thereon, taken along line 4—4 of FIG. 1.

Accordingly, as shown in FIG. 4B, with the syringe 18 removed from the mouth guard 20, the closure cap 16 may simply be removably screwed into place on the syringe/cap connector portion 34 of the mouth guard 20. This conveniently permits the pacifier 10 to be used purely as a pacifier, with the removably installed closure cap 16 serving to block a rear end portion of the pacifier passage 38 so that the infant may suck on the comfortable nipple 14 without undesirably drawing air inwardly through the nipple 14 via the syringe/cap connector portion 34 of the pacifier.

AS can be seen, the pacifier 10 is of a simple, easy to manufacture construction and may be used as either a conventional pacifier or as an oral liquid administering device for an infant which is useable without a sucking force being exerted on its specially configured nipple portion.

The foregoing detailed description is to be clearly understood as being given by way of illustration and example only, the spirit and scope of the present invention being limited solely by the appended claims.

What is claimed is:

1. A pacifier comprising:

a body member having front and rear sides, and an opening extending therethrough from said front side to said rear side;

a hollow connector member carried on said rear side of said body member and having an interior flow passage communicated with said opening, said hollow connector member being threadingly connectable directly to the outlet end of a liquid dispensing syringe to receive liquid discharged therefrom; and a nipple projecting outwardly from said front side of said body member and being operative to receive liquid, for subsequent operative forward discharge from said nipple, only via said interior flow passage of said hollow connector member.

2. The pacifier of claim 1 further comprising:

a closure cap member securable to said connector member in place of the syringe and operative to prevent liquid flow through said interior flow passage of said hollow connector member.

3. The pacifier of claim 1 wherein:

said hollow connector member projects rearwardly beyond said rear side of said body member and has a hollow tubular configuration with an outer end from which a diametrically opposed pair of exterior tabs radially outwardly project.

4. The pacifier of claim 3 wherein:

said body member is a plastic mouth guard, and said hollow connector member is molded integrally with said plastic mouth guard.

5. The pacifier of claim 1 wherein said nipple is formed from a pliable material tube having:

a first outer end secured to said front side of said body member over said opening therein, a longitudinally intermediate portion spaced forwardly apart from said front side of said body member, a first end portion extending from said first outer end to said longitudinally intermediate portion, a second outer end, and a second end portion extending from said longitudinally intermediate portion to said second outer end, said second end portion being everted and coaxially extending rearwardly and outwardly along said first end portion, with said second outer end being secured to said front side of said body member.

6. The pacifier of claim 5 wherein:

said pliable material tube is of an imperforate construction, said second end portion of said pliable material tube is radially larger than said first end portion thereof, with an annular space being defined between said first and second end portions, and said body member completely blocks liquid flow forwardly into said annular space.

7. The pacifier of claim 5 wherein:

said pacifier further comprises a tubular nipple connector portion projecting forwardly from said front side of said body member and having an interior communicating with said body member opening, said tubular nipple connector portion being closely and coaxially received in said first outer end of said pliable material tube.

8. The pacifier of claim 7 wherein:

said pacifier further comprises an annular nipple connector portion projecting forwardly from said front side of said body member and outwardly circumscribing said tubular nipple connector portion, said annular nipple connector portion being closely and coaxially received in said second outer end of said pliable material tube.

9. A pacifier comprising:

a body member having front and rear sides, and an opening extending therethrough from said front side to said rear side; and a nipple projecting outwardly from said front side of said body member, said nipple being formed from a pliable material tube having:

a first outer end secured to said front side of said body member over said opening therein, a longitudinally intermediate portion spaced forwardly apart from said front side of said body member, a first end portion extending from said first outer end to said longitudinally intermediate portion, a second outer end, and a second end portion extending from said longitudinally intermediate portion to said second outer end, said second end portion being everted and coaxially extending rearwardly and outwardly along said first end portion, with said second outer end being secured to said front side of said body member and being substantially axially aligned with said first outer end, said second end portion of said pliable material tube being radially larger than said first end portion thereof, with an annular space being defined between said first and second end portions said body member completely blocking fluid flow forwardly into said annular space.

10. The pacifier of claim 9 wherein:

said pacifier further comprises a tubular nipple connector portion projecting forwardly from said front side of said body member and having an interior communicating with said body member opening, said tubular nipple connector portion being closely and coaxially received in said first outer end of said pliable material tube.

11. The pacifier of claim 10 wherein:

said pacifier further comprises an annular nipple connector portion projecting forwardly from said front side of said body member and outwardly circumscribing said tubular nipple connector portion, said annular nipple connector portion being closely and coaxially received in said second outer end of said pliable material tube.

12. A liquid dispensing pacifier useable with a syringe having an interiorly threaded discharge end portion, said liquid dispensing pacifier comprising:

a mouth guard having front and rear sides, and an opening extending therethrough from said front side to said rear side;

a hollow tubular connector member extending outwardly from said rear side of said mouth guard and having an outer end from which a diametrically opposed pair of exterior tabs radially outwardly project, said hollow tubular connector member being threadingly and removably connectable to the discharge end of the syringe and having an interior flow passage communicated with said opening in said mouth guard;

a closure cap member having an internally threaded portion with a configuration similar to that of the interiorly threaded discharge end portion of the syringe and being threadingly connectable to said hollow tubular connector member in place of the syringe and in a manner preventing fluid flow through said hollow tubular connector member; and a nipple projecting outwardly from said front side of said mouth guard and having an interior flow passage communicated with said opening in said mouth guard, said nipple being formed from a pliable material tube having a first outer end secured to said front side of said mouth guard over said opening therein, a longitudinally intermediate portion spaced forwardly apart from said front side of said mouth guard, a first end portion extending from said first outer end to said longitudinally intermediate portion, a second outer end, and a second end portion extending from said longitudinally intermediate portion to said second outer end, said second end portion being everted and coaxially extending rearwardly and outwardly along said first end portion, with said second outer end being secured to said front side of said mouth guard, said second end portion of said pliable material tube being radially larger than said first end portion thereof, with an annular space being defined between said first and second end portions of said pliable material tube, said nipple being operative to permit longitudinal fluid flow therethrough only via the interior of said first end portion thereof.

13. The liquid dispensing pacifier of claim 12 wherein:

said mouth guard is of a molded plastic construction, and said hollow tubular connector member is molded integrally with said mouth guard.

14. The liquid dispensing pacifier of claim 12 wherein:

said mouth guard completely blocks forward fluid flow into said annular space.

15. The liquid dispensing pacifier of claim 12 wherein:

said liquid dispensing pacifier further comprises a tubular nipple connector portion projecting forwardly from said front side of said mouth guard and having an interior communicating with said body member opening, said tubular nipple connector portion being closely and coaxially received in said first outer end of said pliable material tube.

16. The pacifier of claim 15 wherein:

said liquid dispensing pacifier further comprises an annular nipple connector portion projecting forwardly from said front side of said mouth guard and outwardly circumscribing said tubular nipple connector portion, said annular nipple connector portion being closely and coaxially received in said second outer end of said pliable material tube.

17. The liquid dispensing pacifier of claim 12 wherein:

said pliable material tube is of an imperforate construction.

18. A pacifier comprising:

a mouth guard having front and rear sides, and an opening extending therethrough from said front side to said rear side;

a hollow tubular connector member carried on said rear side of said mouth guard, said connector member having an interior flow passage communicated with said opening, and an outer end having first and second circumferentially spaced apart tabs projecting radially outwardly therefrom, said outer end of said connector member being threadingly connectable internally within the tubular outlet end of a liquid dispensing syringe to receive liquid discharged therefrom; and a nipple projecting outwardly from said front side of said mouth guard and having an interior flow passage communicated with said opening in said mouth guard.

* * * * *